US011541402B2

(12) United States Patent
König

(10) Patent No.: US 11,541,402 B2
(45) Date of Patent: Jan. 3, 2023

(54) SEPARATOR DRUM WITH PISTON SLIDE VALVE AND CLOSING CHAMBER

(71) Applicant: FLOTTWEG SE, Vilsbiburg (DE)
(72) Inventor: Thomas König, Vilsbiburg (DE)
(73) Assignee: FLOTTWEG SE, Vilsbiburg (DE)

( * ) Notice: Subject to any disclaimer, the term of this patent is extended or adjusted under 35 U.S.C. 154(b) by 322 days.

(21) Appl. No.: 16/763,960
(22) PCT Filed: Dec. 3, 2018
(86) PCT No.: PCT/EP2018/083267
§ 371 (c)(1),
(2) Date: May 13, 2020
(87) PCT Pub. No.: WO2019/110465
PCT Pub. Date: Jun. 13, 2019

(65) Prior Publication Data

US 2020/0391226 A1 Dec. 17, 2020

(30) Foreign Application Priority Data

Dec. 5, 2017 (DE) ..... 102017128867.8
Mar. 1, 2018 (DE) ..... 102018104700.2

(51) Int. Cl.
*B04B 1/14* (2006.01)
*B04B 11/04* (2006.01)

(52) U.S. Cl.
CPC ..... *B04B 1/14* (2013.01); *B04B 11/04* (2013.01)

(58) Field of Classification Search
CPC ..... B04B 1/14; B04B 11/04
(Continued)

(56) References Cited

U.S. PATENT DOCUMENTS 4,410,319 A * 10/1983 Zettier ..... B04B 1/14 494/56
4,643,708 A * 2/1987 Stroucken ..... B04B 1/14 494/40
2016/0016182 A1* 1/2016 Bodelson ..... B04B 1/14 494/56

FOREIGN PATENT DOCUMENTS

DE 3117807 C1 1/1983 ..... B04B 1/14
EP 0192676 B1 10/1988 ..... B04B 1/14
(Continued)

OTHER PUBLICATIONS

The Notification Concerning Transmittal of Copy of International Preliminary Report on Patentability (Chapter I of the Patent Cooperation Treaty), in English, dated Jun. 18, 2020, which was issued by the International Bureau of WIPO in Applicant's corresponding international PCT application having Serial No. PCT/EP2018/083267, filed on Dec. 3, 2018.
(Continued)

*Primary Examiner* — Shuyi S. Liu
(74) *Attorney, Agent, or Firm* — Bodner & O'Rourke, LLP; Gerald T. Bodner; Christian P. Bodner

(57) ABSTRACT

The invention relates to a separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, in particular closing water, wherein the closing chamber (30) is formed between an underside (21) of the piston slide valve (20) and a top side (35) of a drum lower part (15). According to the invention, the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and of the top side (35) of the drum lower part (15), and the second closing chamber portion (32) has at least in part a conical cross section.

28 Claims, 3 Drawing Sheets

Figure 1:
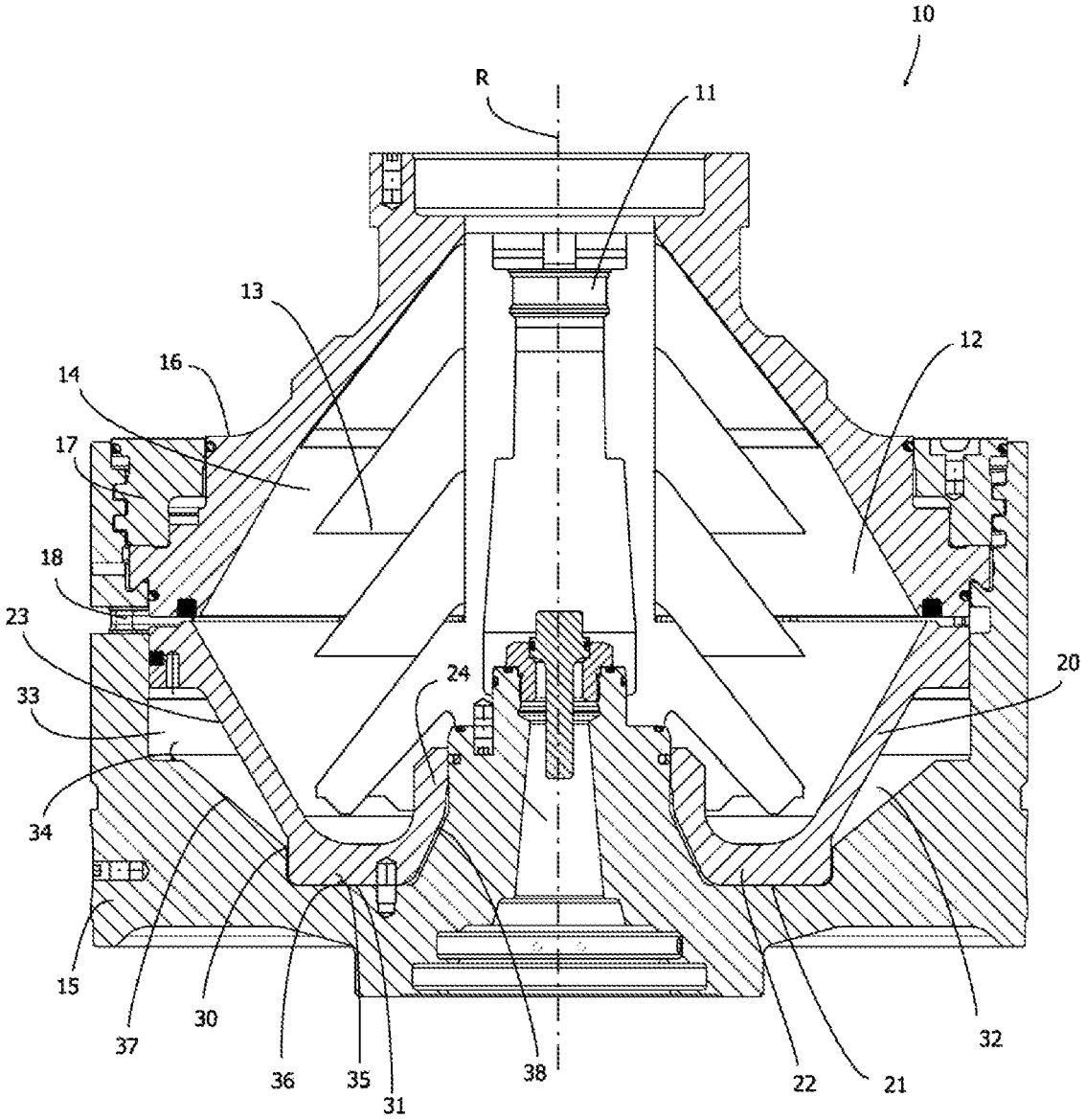

(58) Field of Classification Search
USPC ..... 494/1, 22, 23, 27
See application file for complete search history.

(56) References Cited

FOREIGN PATENT DOCUMENTS

| | | | | |
|---|---|---|---|---|
| EP | 2774684 A1 | 9/2014 | ..... | B04B 1/14 |
| FR | 2505206 A1 | 11/1982 | ..... | B04B 1/14 |
| JP | S521761 A | 1/1977 | ..... | B04B 1/14 |

OTHER PUBLICATIONS

The English translation of the International Preliminary Report on Patentability (Chapter I of the Patent Cooperation Treaty), dated Jun. 9, 2020, which was issued by the International Bureau of WIPO in Applicant's corresponding international PCT application having Serial No. PCT/EP2018/083267, filed on Dec. 3, 2018.

The Written Opinion of the International Searching Authority, in English, dated Feb. 14, 2019, which was issued by the International Bureau of WIPO in Applicant's corresponding international PCT application having Serial No. PCT/EP2018/083267, filed on Dec. 3, 2018.

The International Search Report, in English, dated Feb. 14, 2019, which was issued by the International Bureau of WIPO in Applicant's corresponding international PCT application having Serial No. PCT/EP2018/083267, filed on Dec. 3, 2018.

* cited by examiner

SEPARATOR DRUM WITH PISTON SLIDE VALVE AND CLOSING CHAMBER

The invention relates to a separator drum with a hydraulically actuated, axially movable piston slide valve which can seal off a solids space from at least one solids outlet, wherein the piston slide valve can be held in its closed position via a closing chamber that can be filled with closing liquid, in particular closing water, wherein the closing chamber is formed between an underside of the piston slide valve and a top side of a drum lower part according to claim 1.

Separator drums or centrifugal drums for centrifuges are well known from the state of the art. It is moreover known to perform partial emptying processes or full emptying processes in connection with such separator drums. For this purpose, a plurality of embodiments of separator drums is known which include control systems having chambers which receive the entire closing liquid in the event of full emptying and are prefilled in the event of partial emptying processes.

It applies in a quite general sense that the opening and closing of a separator drum is based on up and down movement of a piston slide valve. The piston slide valve is part of a hydraulically controlled system. The up and down movement of the piston slide valve is achieved by different pressure conditions, with the different pressure conditions resulting from different levels of the closing liquid within the closing chamber of the drum during the emptying operation. If closing liquid is discharged from the closing chamber, the piston slide valve sinks downward so that the separator drum is opened. A solids outlet from the solids space is released by the piston slide valve moving downward.

In the context of such opening systems, there is a so-called virtual diameter (D1) where—in purely mathematical terms—during normal operation, a balance is present between the opening force resulting from the drum filling and the closing force resulting from the closing liquid present within the closing chamber. If the closing liquid level is less than D1, the drum is closed. If the closing liquid level is more than D1, the drum is open. This coherence applies to all of hydraulic opening systems of separator drums.

In order to achieve a rapid emptying or partial emptying of the separator drum, the piston slide valve needs to be rapidly moved upward again subsequent to releasing the solids outlet. The movement of the piston slide valve inter alia depends on how fast so-called drum valves can be closed again. In order to open drum valves, a certain opening liquid level is required. This liquid level forms within bores or channels of an opening liquid collection chamber extending to the drum valves of the separator drum.

The diameter at which a balance is present between an open drum valve and a closed drum valve in normal operation, is also approximately in the range of the diameter D1. Here, it applies in a general sense that the valve is opened in case of an opening liquid level of less than D1. In case of an opening liquid level of more than D1, however, the valve is closed.

Hitherto known constructions with respect to the opening of separator drums have the disadvantage that the discharging closing liquid cannot be influenced, on the one hand, and the amount of necessary closing liquid is relatively large, on the other, so that it takes a relative long time for the closing liquid level to exceed the diameter D1 and an opened separator drum is present.

Starting from the depicted state of the art, the task of the present invention is to propose a separator drum with an opening system, wherein the partial emptying of the separator drum should be performed in shorter time. Furthermore, full emptying should also be possible using the same separator drum.

This task is solved by the subject matter of claim 1, the dependent claims comprising at least appropriate configurations and further developments.

Accordingly, a separator drum with a hydraulically actuated, axially movable piston slide valve is taken as a basis, which can seal off a solids space from at least one solids outlet, wherein the piston slide valve can be held in its closed position via a closing chamber that can be filled with closing liquid, in particular closing water, wherein the closing chamber is formed between an underside of the piston slide valve and a top side of a drum lower part.

According to the invention, the closing chamber has a first closing chamber portion near the rotation axis and a second closing chamber portion remote from the rotation axis, wherein the first closing chamber portion is formed by two mutually parallel portions of the underside of the piston slide valve and the top side of the drum lower part, and the second closing chamber portion has at least in part a conical cross section.

The rotation axis relates to the rotation axis of the separator drum. In other words, the first closing chamber portion is a closing chamber portion situated further inside in relation to the second closing chamber portion. The second closing chamber portion is a closing chamber portion situated further outside in relation to the first closing chamber portion.

In other words, the closing chamber has at least two closing chamber portions. The closing chamber portions should merely be understood as sub-areas of the closing chamber. In this case, these are portions that are not fluidically separated from one another. The first closing chamber portion is the portion of the closing chamber arranged closer to the rotation axis of the separator drum. The second closing chamber portion is the portion of the closing chamber arranged to be more remote from the rotation axis of the separator drum. Preferably, the first closing chamber portion is adjacent to the second closing chamber portion.

The first closing chamber portion is formed by two mutually parallel portions of the underside of the piston slide valve and the top side of the drum lower part. Due to the mutually parallel portions, the first closing chamber portion has a constant spacing in cross section. The spacing given in case of a closed separator drum, i.e. in a closed position of the piston slide valve, is in this case relatively small. The spacing preferably is 0.5 mm to 5.0 mm. The first closing chamber portion is formed in particular by the corresponding portion of the underside of the piston slide valve being formed to be complementary to the corresponding portion of the top side of the drum lower part.

The second closing chamber portion has a conical cross section at least in portions. A conical cross section is meant to be such a conical cross section which is formed to be cone-shaped at least in portions. In a section through the separator drum, a corresponding cross section is present from the top to the bottom.

Due to the conically formed cross section, a second closing chamber portion having an enlarged chamber volume can be formed as compared to a cross section formed based on a constant spacing between the underside of the piston slide valve and the top side of the drum lower part.

Preferably, the second closing chamber portion is formed by two mutually angled portions of the underside of the piston slide valve and the top side of the drum lower part.

The two portions of the underside of the piston slide valve and the top side of the drum lower part, that are mutually arranged at an angle, preferably enclose an angle of 10°-45°, in particular of 15° to 40°, in particular of 17°-35, in particular of 18°-30°, in particular of 19° to 25°, in particular of 20°.

The conical cross section preferably is configured such that the portion having the smaller cross section points toward the first closing chamber portion. The portion of the second closing chamber portion having the smallest cross section preferably is adjacent to the first closing chamber portion. In order to be able to form a second closing chamber portion having a conical cross section, the underside of the piston slide valve and the top side of the drum lower part are not formed to be mutually parallel but to be mutually at an angle.

The ratio of the closing liquid volume in the first closing chamber portion to the closing liquid volume in the second closing chamber portion preferably is from 1:5 to 1:15, in particular 1:10.

The separator drum, in particular the closing chamber, is configured such that the closing liquid proportion that is less than the virtual diameter D1, is relatively small. A small closing liquid amount in the area of the virtual diameter D1 has a positive effect on the velocity of the opening operation during emptying of the separator. Thus, it is possible for the inner closing liquid level, i.e. the closing liquid level in the first closing chamber portion, to be able to exceed the virtual diameter D1 to the outside very quickly.

The first closing chamber portion preferably is formed in the area of the virtual diameter D1. As already mentioned, the virtual diameter D1 is the virtual diameter where in mathematical terms a balance is present between the opening force due to the drum filling and the closing force due to the closing liquid present within the closing chamber. Alternatively, it is possible for the transition area from the first closing chamber portion to the second closing chamber portion to be formed in the area of the virtual diameter D1.

In a particularly preferred embodiment of the invention, the virtual diameter D1 is formed to be approximately centered in the first closing chamber portion.

The closing liquid proportion that is greater than the diameter D1 is relatively large. This is enabled due to the conical cross section of the second closing chamber portion.

The separator drum has at least one drum valve. The separator drum comprises preferably at least two drum valves. The number of drum valves may be both even and uneven.

A drum valve serves to discharge closing liquid. Between the first closing chamber portion and the at least one drum valve, a first outflow channel is formed. Between the second closing chamber portion and the at least one drum valve, a second outflow channel is formed.

Preferably, the inner diameter of the first outflow channel is larger than the inner diameter of the second outflow channel.

The closing liquid present within the closing chamber can be carried to a drum valve due to the two outflow channels. In other words, the closing liquid can be discharged toward the drum valve due to the two separately formed outflow channels.

A nozzle is preferably formed in the second outflow channel. This second outflow channel is the channel having a smaller inner diameter. The second outflow channel may have an inner diameter of 0.5 mm to 5.0 mm.

The configuration according to the invention of the separator drum having the two outflow channels has the advantage that the relatively small closing liquid amount of the first closing chamber portion may be transferred directly to at least one drum valve via the first outflow channel having a relatively large inner diameter, and subsequently may be discharged extremely quickly from the rotating separator drum via the at least one drum valve.

Due to that, the piston slide valve may be moved downward extremely quickly. The relatively large closing liquid amount present within the second closing chamber portion is carried at the same time to the at least one drum valve via the second outflow channel which has a relatively small inner diameter.

Due to the relatively small inner diameter of the second outflow channel and the preferable formation of a nozzle, the flowing off of the closing liquid is delayed such that the at least one opened drum valve is again already closed prior to the closing liquid having been completely discharged or flown out.

A closing liquid permanently refilled from outside during partial emptying tops up again the run off or drained closing water or the closing liquid at the same time.

The piston slide valve situated in the lowermost position during the emptying process is pressed upward again due to that after a relatively short time so that the separator drum is closed again. In other words, the solids outlet of the solids space may be sealed again due to the piston slide valve having been pushed upward. A complete or too long flowing off of the closing liquid is in particular prevented due to the formation of two closing chamber portions and the associated formation of two outflow channels.

The ratio of the inner diameter of the first outflow channel to the inner diameter of the second outflow channel preferably is 1:3 to 1:15.

An opening of the second outflow channel is preferably formed in the area or the proximity of the largest diameter of the closing chamber. This enables the largest proportion of the closing liquid present within the first closing chamber portion to flow out through the first outflow channel, and the closing liquid present within the second closing chamber portion to flow out likewise, in particular at the same time.

The second outflow channel is preferably formed perpendicular to the first outflow channel. In other words, the two outflow channels are formed to be mutually right-angled. Preferably, the second outflow channel is formed in the vertical direction. The first outflow channel preferably is formed in the horizontal direction. The second closing chamber portion preferably ends in an outer portion which has a horizontal terminal surface. Preferably, the second outflow channel is formed perpendicular to this horizontal terminal surface. The opening of the second outflow channel preferably is formed in the horizontal terminal surface.

In a further embodiment of the invention it is possible for the outflow channels to be formed mutually obliquely.

The flow off diameter of the first closing chamber portion may be greater than or equal to the virtual diameter. In other words, the dimension of the flow off diameter of the first closing chamber portion may be greater that the dimension of the virtual diameter. In addition, the dimension of the flow off diameter may approximately have the same diameter as the virtual diameter.

Due to the formation of the separator drum according to the invention, a separator drum is provided whose opening times of the piston slide valve are shortened as compared to the state of the art. Furthermore, the switching times of the drum valve of the separator drum can be shortened.

Hereinafter, the invention will be explained in more detail on the basis of exemplary embodiments with reference to the enclosed schematic drawings.

Figure 2:
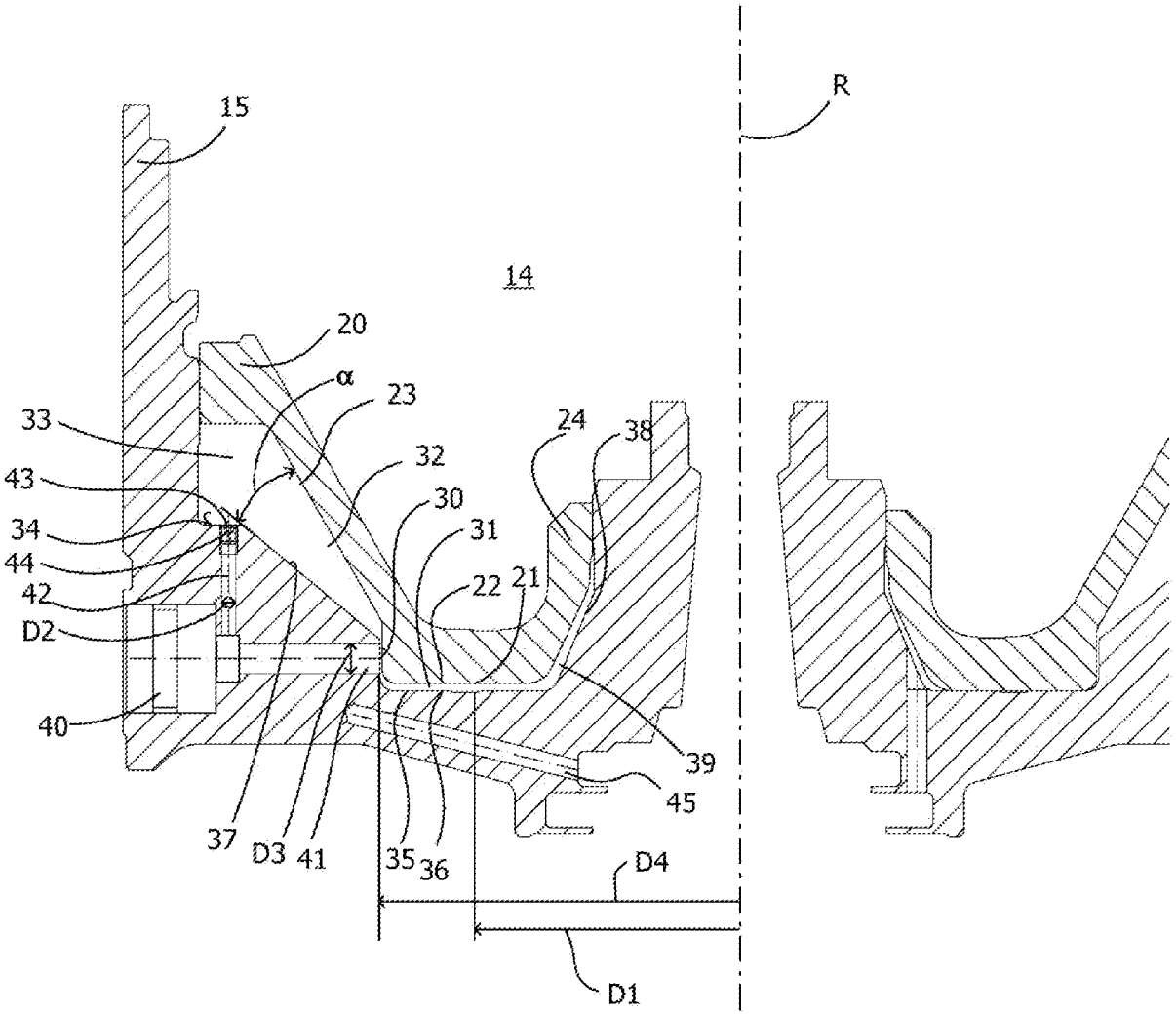
Figure 3:
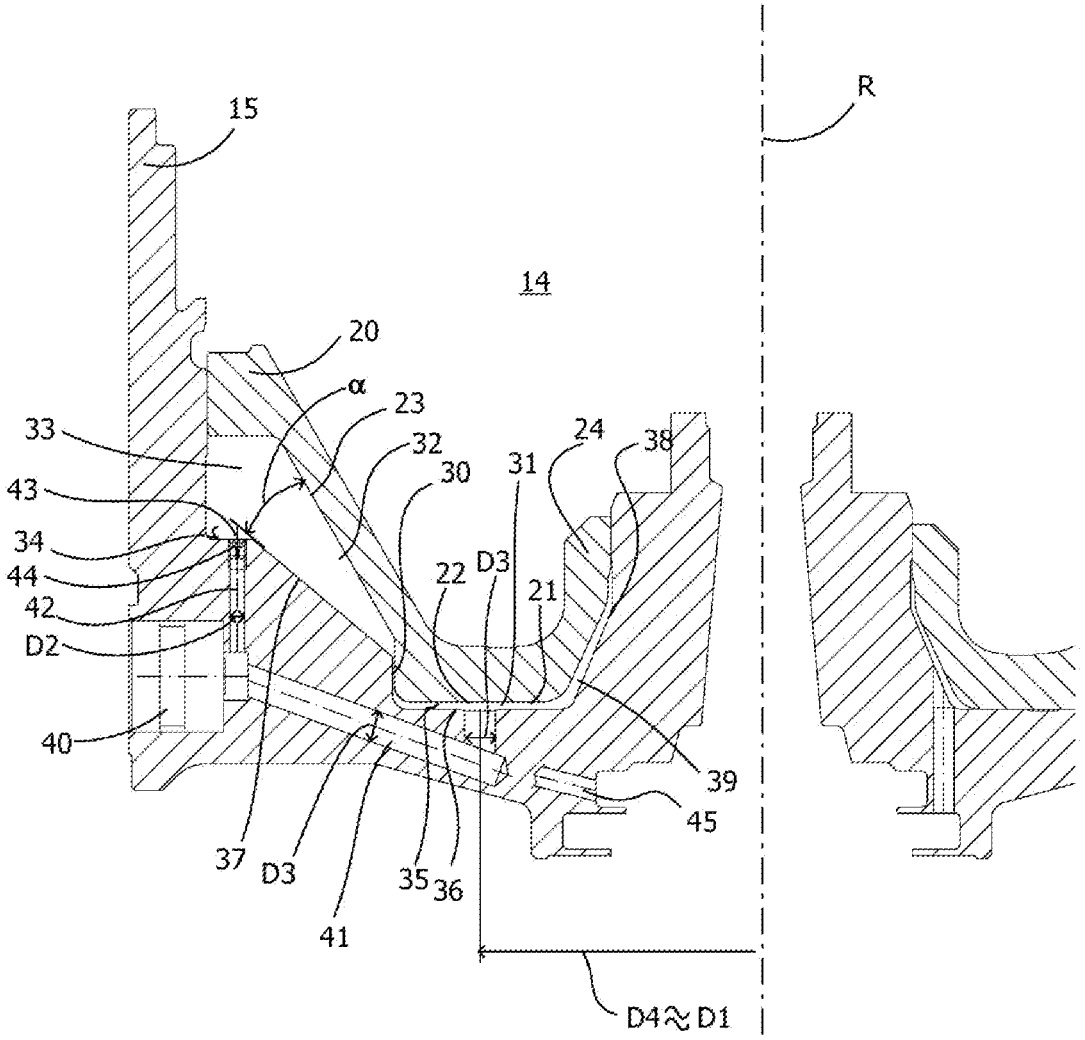

Shown are in:

FIG. 1 a cross section of a separator drum according to the invention;

FIG. 2 an enlarged representation of the area around the closing chamber according to a first exemplary embodiment of the invention; and FIG. 3 an enlarged representation of the area around the closing chamber according to a second exemplary embodiment of the invention.

In the following, the same reference numerals will be used for identical parts or parts of identical action.

A separator drum 10 is illustrated. It has a central inlet 11 for a mixture of solids and liquid to be separated, via which the mixture of solids and liquid reaches a centrifuge space 12. The centrifuge space 12 is composed of a separating space 13 and a solids space 14. The solids space 14 is formed as a double cone and delimited by a piston slide valve 20 in its lower area.

In its upper area, the separator drum 10 is closed by a drum cover 16 which is connected to a drum lower part 15 by a closure ring 17. The piston slide valve 20 may close or release an outlet 18 provided in the drum lower part 15. In FIG. 1, the piston slide valve 20 is illustrated in an opened position. The outlet 18 is released. If the piston slide valve 20 is axially pushed upward within the centrifuge space 12, the outlet 18 can be closed.

The piston slide valve 20 can be hydraulically actuated. For this purpose, a closing chamber 20 is formed which can be filled with a closing liquid, in particular closing water. Due to the level formed within the closing chamber 30, the piston slide valve 20 can be actuated. The closing chamber 30 is formed between the underside 21 of the piston slide valve 20 and the top side 35 of the drum lower part 15.

Since the piston slide valve 20 rests in FIG. 1 upon the top side 35 of the drum lower part 15, the complete closing chamber 30 cannot be recognized.

The closing chamber 30 has a first closing chamber portion 31 near the rotation axis R and a second closing chamber portion 32 remote from the rotation axis R. The first closing chamber portion 31 is formed by two mutually parallel portions (22, 36) of the underside 21 of the piston slide valve 20 and the top side 35 of the drum lower part 15. In other words, the portion 22 of the piston slide valve 20 or the portion 22 of the underside 21 of the piston slide valve 20 is formed to be parallel to the portion 36 of the drum lower part 15 or the portion 36 of the top side 35 of the drum lower part 15. The distance between the portions 22 and 36 thus remains the same when the piston slide valve 20 is pushed upward. Accordingly, a substantially hollow circle-cylindrical first closing chamber portion 31 is formed between the portions 22 and 36.

The second closing chamber portion 32 has at least in part a conical cross section. This conical cross section can be recognized in FIG. 1 in which the piston slide valve 20 is in an opening position. This conical cross section remains maintained even at a closing position of the piston slide valve 20. The conical cross section is formed such that the dimension of the cross section decreases toward the first closing chamber portion 31. The second closing chamber portion 32 is adjacent to the first closing chamber portion 31.

The second closing chamber portion 32 furthermore has an outer portion 33 with a horizontal terminal surface 34.

The second closing chamber portion 32 is formed by two portions mutually arranged at an angle. The second closing chamber portion 32 is in particular built by the portion 23 of the underside 21 of the piston slide valve 20 and the portion 37 of the top side 35 of the drum lower part 15.

The two portions 23 and 37 of the underside 21 of the piston slide valve 20 and the top side 35 of the drum lower part 15, that are mutually arranged at an angle, enclose an angle $\alpha$ of in particular 20° (see FIG. 2).

In FIG. 2, the closing chamber 30 and an associated drum valve 40 according to a first exemplary embodiment are illustrated in an enlarged manner. In FIG. 2, the piston slide valve 20 is illustrated in a slightly lifted position. This allows to recognize that the closing chamber 30 is in particular built of the two closing chamber portions 31 and 32. Between a substantially vertical portion 24 of the piston slide valve 20 and a vertical portion 38 of the drum lower part 15, a slit-like portion 39 of the closing chamber 30 is formed.

The so-called virtual diameter D1 is sketched in FIG. 2. During normal operation, there is a balance in mathematical terms at this virtual diameter D1 between the opening force generated by the drum filling and the closing force generated by the closing liquid present within the closing chamber 30. It can be recognized that the separator drum 10, in particular the closing chamber 30, is formed such that the virtual diameter D1 is formed in the area of the first closing chamber portion 31. In particular, the virtual diameter D1 is formed to be approximately centered in the first closing chamber portion 31.

In general, the principle applies that the separator drum 10 is closed if the closing liquid level is less than D1. If the closing liquid level is more than D1, the separator drum 10 is opened. The closing liquid proportion that is less than the diameter D1, thus is relatively small. Since the second closing chamber portion 32 has a relatively large volume due to the conical cross section, the closing liquid proportion that is more than the diameter D1 is relatively large.

Also, a drum valve 40 of the separator drum 10 can be recognized in FIG. 2. Between the first closing chamber portion 31 and the drum valve 40, a first outflow channel 41 is formed. Whereas between the second closing chamber portion 32 and the drum valve 40, a second outflow channel 42 is formed. The second outflow channel 42 is substantially formed to be perpendicular to the first outflow channel 41.

It can be recognized that the inner diameter D3 of the first outflow channel 41 is larger than the inner diameter D2 of the second outflow channel 42. The second outflow channel 42 has in particular an inner diameter D2 of 1.5 mm. The opening 43 of the second outflow channel 42 is formed in the area of the largest diameter of the closing chamber 30. The opening 43 is in particular formed in the horizontal terminal surface 34.

It can moreover be recognized that the diameter D4, i.e. the discharge diameter of the first closing chamber portion 31 is larger than the virtual diameter D1.

The formation of the separator drum 10, in particular the piston slide valve 20 and the closing chamber 30 according to the invention results in the following advantages:

The relative low amount of closing liquid in the first closing chamber portion 31 may be carried directly to the drum valve 40 via the first outflow channel 41 which has a relatively large inner diameter D3. Via this drum valve 40, this proportion of the closing liquid may be discharged very quickly from the separator drum 10. Due to that, the piston slide valve 20 is moved downward very quickly.

The relatively large amount of closing liquid in the second closing chamber portion 32 is carried simultaneously via the second outflow channel 42. This second outflow channel 42, however, has a relatively small inner diameter D2. Due to that, the flow off of the closing water flowing in is delayed such that the opened drum valve 40 can be closed again already before the closing liquid is discharged completely.

For delaying the flow off of the closing liquid proportion from the second closing chamber portion 32, a nozzle 44 is moreover formed in the second outflow channel 42.

The closing liquid permanently topped up from outside during a partial emptying process, simultaneously tops up the discharged closing liquid again.

The piston slide valve 20 situated in the lowermost position during the emptying operation may thus be pressed again upward after a relatively short time so as to subsequently close the separator drum 10 or the outlet 18 again.

Due to that, the switching times of the drum valve 40 are significantly shortened.

As indicated in FIG. 2, the drum valve 40 is in known manner in operative connection with an opening liquid system. For this purpose, an opening liquid channel 45 is formed.

In FIG. 3, the closing chamber 30 and an associated drum valve 40 according to a second exemplary embodiment are illustrated in an enlarged manner. In FIG. 3, the piston slide valve 20 is illustrated in a slightly lifted position. In this case, it can be seen that the closing chamber 30 is in particular built of the two closing chamber portions 31 and 32.

First, the exemplary embodiment of FIG. 3 differs from the exemplary embodiment according to FIG. 2 in that the diameter D4, i.e. the flow off diameter of the first closing chamber portion 31 is (approximately) identical to the virtual diameter D1.

In this context, the first outflow channel 41 has two portions, namely a first, vertical portion, and a second, oblique portion. In this case, the first, vertical portion begins in an opening of the top side 35 of the drum lower part 15 and ends in the second, oblique portion. The second, oblique portion in turn ends in the drum valve 40.

It is moreover illustrated in FIG. 3 that the first outflow channel 41 and the second outflow channel 42 extend mutually obliquely, i.e. not mutually perpendicular.

LIST OF REFERENCE NUMERALS

10 separator drum
11 central inlet
12 centrifuge space
13 separating space
14 solids space
15 drum lower part
16 drum cover
17 closure ring
18 (solids) outlet
20 piston slide valve
21 underside of piston slide valve
22 portion of piston slide valve
23 portion of piston slide valve
24 vertical portion
30 closing chamber
31 first closing chamber portion
32 second closing chamber portion
33 outer portion
34 horizontal terminal surface
35 top side of drum lower part
36 portion of drum lower part
37 portion of drum lower part
38 vertical portion
39 slit-like portion
40 drum valve
41 first outflow channel
42 second outflow channel
43 opening of second outflow channel
44 nozzle
45 opening liquid channel
D1 virtual diameter
D2 inner diameter of second outflow channel
D3 inner diameter of first outflow channel
D4 flow off diameter of first closing chamber portion
$\alpha$ angle of second closing chamber portion

The invention claimed is:

1. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, the second closing chamber portion (32) is formed by two portions (23; 37) of the underside (21) of the piston slide valve (20) and the top side (35) of the drum lower part (15), that are mutually arranged at an angle, and the two portions (23; 37) of the underside (21) of the piston slide valve (20) and the top side (35) of the drum lower part (15), that are mutually arranged at an angle, enclose an angle ($\alpha$) of 10°-45°.

2. The separator drum (10) according to claim 1, characterized in that in the first closing chamber portion (31), a virtual diameter (D1) is formed, where a balance between the opening force by the drum filling and the closing force by the closing liquid situated within the closing chamber (30) is present.

3. The separator drum (10) according to claim 1, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

4. The separator drum (10) according to claim 1, characterized in that at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and an opening (43) of the second outflow channel (42) is formed in the area or in the proximity of the largest diameter of the closing chamber (30).

5. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, characterized in that the ratio of the closing liquid volume in the first closing chamber portion (31) to the closing liquid volume in the second closing chamber portion (32) is from 1:5 to 1:15.

6. The separator drum (10) according to claim 5, characterized in that in the first closing chamber portion (31), a virtual diameter (D1) is formed, where a balance between the opening force by the drum filling and the closing force by the closing liquid situated within the closing chamber (30) is present.

7. The separator drum (10) according to claim 5, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

8. The separator drum (10) according to claim 5, characterized in that at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and an opening (43) of the second outflow channel (42) is formed in the area or in the proximity of the largest diameter of the closing chamber (30).

9. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and the inner diameter (D3) of the first outflow channel (41) is larger than the inner diameter (D2) of the second outflow channel (42).

10. The separator drum (10) according to claim 9, characterized in that in the first closing chamber portion (31), a virtual diameter (D1) is formed, where a balance between the opening force by the drum filling and the closing force by the closing liquid situated within the closing chamber (30) is present.

11. The separator drum (10) according to claim 9, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

12. The separator drum (10) according to claim 9, characterized in that an opening (43) of the second outflow channel (42) is formed in the area or in the proximity of the largest diameter of the closing chamber (30).

13. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and a nozzle (44) is formed in the second outflow channel (42).

14. The separator drum (10) according to claim 13, characterized in that in the first closing chamber portion (31), a virtual diameter (D1) is formed, where a balance between the opening force by the drum filling and the closing force by the closing liquid situated within the closing chamber (30) is present.

15. The separator drum (10) according to claim 13, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

16. The separator drum (10) according to claim 13, characterized in that an opening (43) of the second outflow channel (42) is formed in the area or in the proximity of the largest diameter of the closing chamber (30).

17. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and the second outflow channel (42) has an inner diameter (D2) of 0.5 mm to 5.0 mm.

18. The separator drum (10) according to claim 17, characterized in that in the first closing chamber portion (31), a virtual diameter (D1) is formed, where a balance between the opening force by the drum filling and the closing force by the closing liquid situated within the closing chamber (30) is present.

19. The separator drum (10) according to claim 17, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

20. The separator drum (10) according to claim 17, characterized in that an opening (43) of the second outflow channel (42) is formed in the area or in the proximity of the largest diameter of the closing chamber (30).

21. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and the first outflow channel (41) has an inner diameter (D3) of 2.0 mm to 20.0 mm.

22. The separator drum (10) according to claim 21, characterized in that in the first closing chamber portion (31), a virtual diameter (D1) is formed, where a balance between the opening force by the drum filling and the closing force by the closing liquid situated within the closing chamber (30) is present.

23. The separator drum (10) according to claim 21, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

24. The separator drum (10) according to claim 21, characterized in that an opening (43) of the second outflow channel (42) is formed in the area or in the proximity of the largest diameter of the closing chamber (30).

25. A separator drum (10) with a hydraulically actuated, axially movable piston slide valve (20) which can seal off a solids space (14) from at least one solids outlet (18), wherein the piston slide valve (20) can be held in its closed position via a closing chamber (30) that can be filled with closing liquid, wherein the closing chamber (30) is formed between an underside (21) of the piston slide valve (20) and a top side (35) of a drum lower part (15), characterized in that the closing chamber (30) has a first closing chamber portion (31) near the rotation axis (R) and a second closing chamber portion (32) remote from the rotation axis (R), wherein the first closing chamber portion (31) is formed by two mutually parallel portions (22, 36) of the underside (21) of the piston slide valve (20) and the top side (35) of the drum lower part (15), the second closing chamber portion (32) has at least in part a conical cross section, at least one drum valve (40) for discharging closing liquid, wherein between the first closing chamber portion (31) and the at least one drum valve (40), a first outflow channel (41), and between the second closing chamber portion (32) and the at least one drum valve (40), a second outflow channel (42) are formed, and the ratio of the inner diameter (D3) of the first outflow channel (41) to the inner diameter (D2) of the second outflow channel (42) is from 1:3 to 1:15.

26. The separator drum (10) according to claim 25, characterized in that in the first closing chamber portion (31), a virtual diameter (D1) is formed, where a balance between the opening force by the drum filling and the closing force by the closing liquid situated within the closing chamber (30) is present.

27. The separator drum (10) according to claim 25, characterized in that in the first closing chamber portion (31), a virtual diameter (D1) is formed, where a balance between the opening force by the drum filling and the closing force by the closing liquid situated within the closing chamber (30) is present, and a flow off diameter (D4) of the first closing chamber portion (31) is larger than or equal to the virtual diameter (D1).

28. The separator drum (10) according to claim 25, characterized in that an opening (43) of the second outflow channel (42) is formed in the area or in the proximity of the largest diameter of the closing chamber (30).

* * * * *